US005230686A

United States Patent [19]

McAdam, III et al.

[11] Patent Number: 5,230,686

[45] Date of Patent: Jul. 27, 1993

[54] APPARATUS FOR FOLDING PAPER BOXES

[75] Inventors: Hugh A. McAdam, III, Hollis; James Pacocha, Hudson; Robert Tremblay, Hollis, all of N.H.

[73] Assignee: International Paper Box Machine Co., Inc., Nashua, N.H.

[21] Appl. No.: 932,305

[22] Filed: Aug. 19, 1992

[51] Int. Cl.[5] ..... B31B 3/58; B31B 5/58

[52] U.S. Cl. ..... 493/23; 493/29; 493/179

[58] Field of Search ..... 493/1, 2, 23, 29, 179, 493/181, 182

[56] References Cited

U.S. PATENT DOCUMENTS

| | | | |
|---|---|---|---|
| 2,931,277 | 4/1960 | La Bombard | 493/179 |
| 2,986,078 | 5/1961 | Hottendorf | 493/179 |
| 4,527,788 | 7/1985 | Masuda | 493/324 |
| 4,604,083 | 8/1986 | Barny et al. | 493/34 |
| 4,795,416 | 1/1989 | Cogswell et al. | 493/423 |
| 5,035,683 | 7/1991 | Takeda et al. | 493/23 |

*Primary Examiner*—William E. Terrell
*Attorney, Agent, or Firm*—Pearson & Pearson

[57] ABSTRACT

Apparatus for folding blanks particularly those constructed from corrugated cardboard. As a blank advances along a paper line pathway, a first station engages the leading edges of the blank flaps and forces the flaps into an intermediate plane. A second station controls the relative velocity of the flaps along the paper line with respect to the panels to compensate for skew that can occur at other stations. A final station completes the folding operation. The second station includes driven rollers that engage opposite sides of each of the flaps. Independently controlled motors drive these rollers in response to the velocity of the blanks along a paper line pathway and any required offset for skew compensation. The controls can be remotely located from the station. Moreover, the station can accommodate blanks of different thicknesses, position the rollers at different locations on different flaps and accommodate cartons with different widths.

30 Claims, 6 Drawing Sheets

APPARATUS FOR FOLDING PAPER BOXES

BACKGROUND OF THE INVENTION

1. Field of the Invention

This invention generally relates to apparatus for forming corrugated cardboard boxes and more particularly to apparatus for adjusting the position of a flap relative to a panel during the folding operation.

2. Description of Related Art

During the manufacture of paper boxes, paper blanks advance along a paper line pathway for diverse folding and gluing operations. The paper blanks may have "score lines" that divide the blank into sections called "panels" and "flaps". During folding operations, the sections are folded about the score lines to produce the sides, top and bottom of a completed box. In one such folding and gluing operation, preglued edge flaps are folded into a partially overlapping relationship over central, adjoining panels of a blank along certain score lines. The flaps and panels of the blank are glued to produce a completed structure in the form of a folded box.

Prior art apparatus for producing such folding boxes includes a conveyor that engages one or more central panels and advances blanks along a paper line pathway seriatim. The paper line pathway may parallel the score lines that lie between the flaps and adjoining panels. These score lines define the sites of ensuing operations during which the flap is folded about axes, called "fold lines", that are coextensive with the preexisting respective score lines.

As the blank advances along the paper line, it passes below one or more backing bars aligned with the preexisting score lines for a single continuous folding operation. In some apparatus a single continuous folding belt system engages the leading edge of the flap and a contiguous area along the surface of the flap. The belt system comprises a relatively wide belt that runs over a series of pulleys mounted in progressively rotated planes, so the plane of the belt turns from a 0°, or initial, plane to a 180°, or final, plane. As this occurs, the belt folds the flap onto the central panel. Initially the folding belt system coacts with the backing bar to begin the fold. However, the backing bar usually terminates at a point along the paper line intermediate the folding belt section. This allows the folding belt to force the flap against the panel and produces a sharp, oftentimes creased, corner.

Continuous folding belt systems work quite well with thin cardboard or boxes. However, operating problems can result when these folding belt systems are used to fold flaps onto panels of corrugated cardboard blanks. Apparently these problems arise from the construction of the corrugated cardboard itself. As known, corrugated cardboard blanks comprise paper formed into parallel ridges and grooves sandwiched between cardboard faces. Usually the exterior cardboard faces are finished paper, often with surface printing to appear on the outside of the box. As with other blanks, the corrugated paper blanks have a number of score lines that define the sites for various folding operations.

This inherent variation in folding characteristics manifests itself during both manual and automatic folding operations on corrugated cardboard boxes with some conventional folding box folding apparatus. As a blank is folded along a score line parallel to the grooves and ridges, the actual fold line can skew with respect to the score line. When the fold line does skew, the flap does not register with the central panel. This is particularly evident in conventional paper box folding machines using single folding belt systems.

U.S. Pat. No. 5,092,827 issued Mar. 3, 1992 for An Apparatus and Method for Folding Paper Boxes describes an improved paper box folding machine that folds an end flap onto a central panel in three successive operations as the blank travels along a paper line. At a first station the blank moves along the paper line and a first belt system engages the flap. The entrance to this belt system is in the plane of the blank and the exit is at a plane through the fold line, but angularly displaced with respect to the blank. This angular displacement normally is 90°. At a second station an independent belt system driven by the paper line apparatus through a variable speed transmission engages the partially folded flap and advances it relative to the central portion without any further folding motion. Another folding belt system engages the blank and completes the fold about the fold line at a third station.

The use of a variable transmission at the second station accurately establishes the speed of the belt system with respect to paper line speed. However, such stations are usually located at the middle of a paper line that is physically quite long. They also usually include separate structures for two flaps that operate independently. An operator who makes an adjustment on one side of the apparatus usually must then walk around the paper line to adjust the structure on the other side.

The weight and bulk of such apparatus also complicates the maintenance of a parallel relationship within the second station and between the second station and other portions of the apparatus. This is particularly important when apparatus needs to move to accommodate differently sized blanks. It is difficult to design the best support structure for maintaining the parallelism in such apparatus. Moreover, this weight also may subject the apparatus to premature wear.

SUMMARY

Therefore it is an object of this invention to provide an apparatus for adjusting the position of a flap with respect to a score line on a blank.

Another object of this invention is to provide improved apparatus for adjusting the position of a flap relative to a score line that can be controlled from a position remote to the operation.

Still another object of this invention is to provide apparatus for adjusting the position of a flap relative to a score line that improves reliability and minimizes set up efforts.

Yet still another object of this invention is to provide apparatus for adjusting the position of a flap relative to a score line that is adapted for use with blanks having a wide variety of thicknesses and configurations.

In accordance with this invention, the improved apparatus for a flap advancing station includes means for engaging both sides of a flap and adjusting the flap position relative to its attached panel and to the score line by advancing the flap at a speed that differs from the speed at which the panel advances along a paper line pathway. A motor directly drives the flap engaging means. A motor controller responds both to paper line pathway speed and offset input signals to control motor speed and hence the velocity of a flap relative to the panel velocity.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
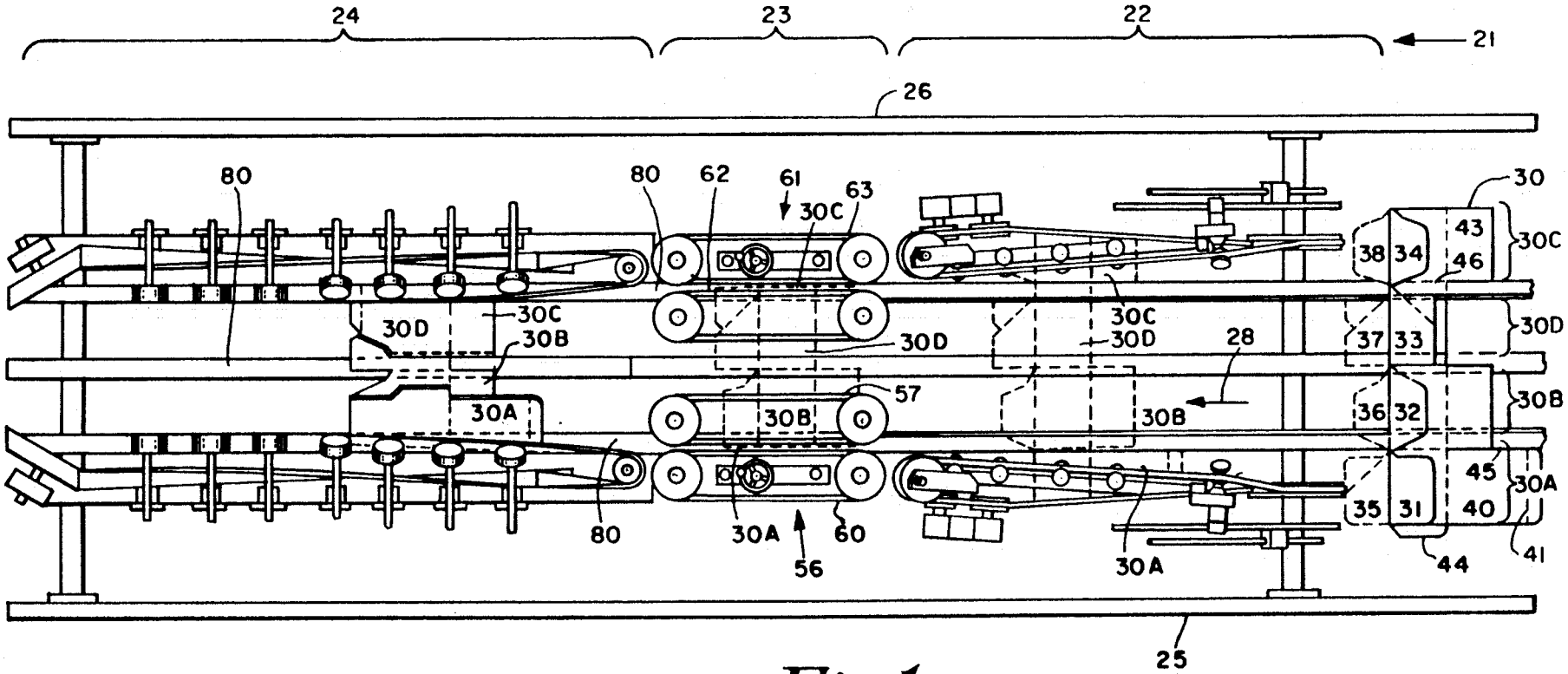
Fig. 1. PRIOR ART
FIG. 1 is a top view of a portion of a prior art paper box folding machine.

As shown in FIG. 1, a paper box folding machine 20 constructed in accordance with U.S. Pat. No. 5,092,827 comprises a receiving station 21, a first folding station 22, an advancing station 23 and a second folding station 24. Side frames 25 and 26 support the apparatus that comprises these stations. A common drive unit powers each of these stations. Arrow 28 designates a paper line pathway and direction of travel; in FIG. 1 the blanks travel from right to left.

The apparatus shown in FIG. 1 acts on precut and prestamped blanks for producing folded cartons as they travel individually and successively along the horizontal paper line pathway 28. One such blank 30, shown in FIG. 1, contains four rectangular side panels 31, 32, 33 and 34. Four bottom panels 35, 36, 37 and 38 extend from the four rectangular sides 31 through 34 respectively. A top or cover section 40 with a insert flap 41 extends from the side 31 while side flaps 42 and 43 extend from sides 32 and 34 respectively. An overlapping glue tab 44 extends from the outer edge of the side 31. Score lines 45 and 46 represent a number of score lines that separate the various panels and flaps and establish fold lines. These particular score lines are parallel to the grooves of a corrugated cardboard blank 30.

Initially, each blank is planar with the bottom panels 35 through 38 extending from the sides 31 through 34. This outline is represented by a dashed line portion of the panels 35 through 38. Plows, guides and related elements of the receiving station 21 fold the bottom panels 35 through 38 around other score lines back over the sides 31 through 34, so the blank appears as shown by the solid lines when it reaches the first folding station 22. Glue applicators typically apply glue to the bottom flaps 35 and 37 and to the outer edge portion of the side 34 in the receiving section 21.

The stations 21, 22 and 23 fold two portions of the blank 30 into an overlapping relationship with other portions of the blank 30. A flap 30A, that comprises the bottom panel 35, side 31, glue tab 44, cover 40 and insert tab 41, constitutes a first portion. The apparatus folds this flap 30A along the score line 45 over a central panel 30B comprising the bottom panel 36, the side 32 and the side flap 42. Similarly, the apparatus simultaneously folds a flap 30C onto a panel 30D along a score line 46. The flap 30C includes the bottom panel 38, the side 34 and the side cover 43. The panel 30D includes the bottom panel 37 and the side 39. The apparatus also folds and overlaps the outer edge of flap 30C with respect to the glue tab 44.

More specifically the first folding station 22 folds the flaps 30A and 30C to intermediate planes that intersect the respective score lines 45 and 46. Typically this intermediate plane is displaced 90° from the initial plane of the blank 30.

Figure 3:
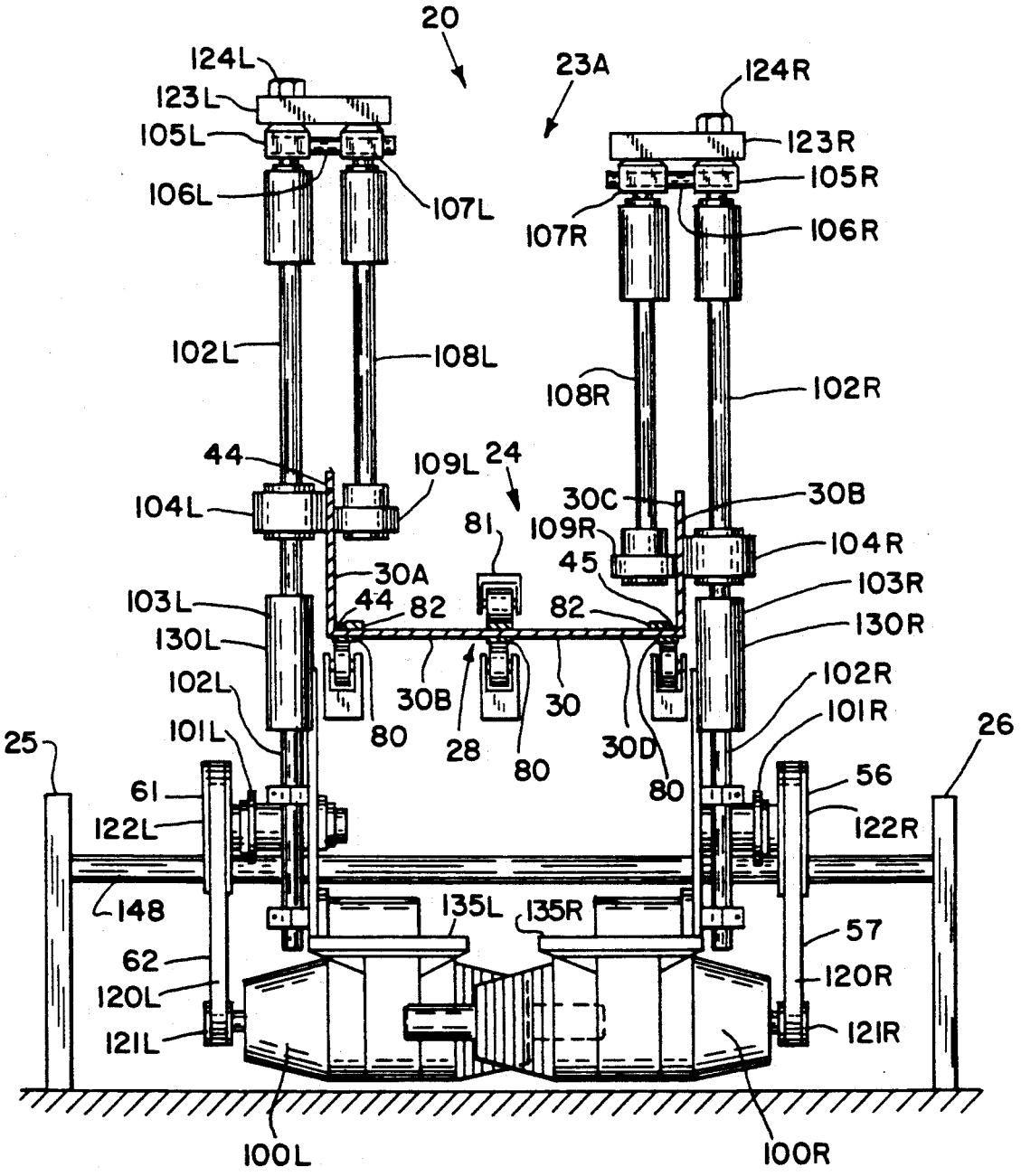
FIG. 3 is a view taken generally along lines 3—3 in FIG. 2.

The flap advancing station 23 engages the flaps 30A and 30C as they exit the first folding station 22. The apparatus the flap advancing station 23 moves the flaps 30A and 30C relative to the panels 30B and 30D, respectively. The panels 30B and 30D move along the paper line path way 28 at a given speed or velocity determined by belt assemblies 80. As best shown in FIG. 3, hold down bar 81 and backing bars 82 keep the panels 30B and 30D in contact with the belt assemblies 80 so the panels advance with the belt assemblies along the paper line pathway 28. Belts 57 and 60 in drive 56 and belts 62 and 63 in drive 61 engage flaps 30A and 30C, respectively. The drives 56 and 61 also independently control the velocities at which the flaps 30A and 30C advance with respect to the panels 30B and 30D. This apparatus compensates skew introduced in the first folding station 22 and that may be introduced in the final folding station 24. As a result, the flaps 30A and 30C are properly aligned with their respective panels 30B and 30D when the blank leaves the final folding station.

The final folding station 24 includes a folding belt system that engages the partially folded flaps 30A and 30C as they exit the flap advancing station 23. The folding belt system folds the flaps 30A and 30C to a final position, typically onto the center panels 30B and 30D. Normally this system times the folding operations for each flap so an edge of the flap 30C overlies the glue tab 44 on the flap 30A.

FIGS 2 THROUGH 6

FIGS. 2 through 6 disclose an embodiment of this invention that provides a flap advancing function and that can replace the section 23 of FIG. 1 with respect to blanks having different thicknesses, flap sizes and panel sizes. Basically a flap advancing station 23A, shown in FIGS. 2 through 6, can be directly substituted for the flap advancing station 23. Thus in the following discussion reference numerals that are common to the prior art embodiment of FIG. 1 and the embodiment of FIGS. 2 through 6 are the same.

Such apparatus typically manipulates two flaps simultaneously. In the following discussion reference numerals have a suffix "R" or "L" to denote a left or right structure as those terms are used facing in the direction of carton travel. That is, from the right to the left in FIG. 2.

Now referring to FIGS. 2 through 5, a flap advancing station 23A contains electric drive motors and power transmission devices. More specifically, in FIGS. 2 through 5 direct current motors 100R and 100L linked through right-angle drives 101R and 101L drive vertical drive shafts 102R and 102L respectively. Splines on each shaft allow that shaft to undergo motion along its vertical axis with respect to the motion. As best seen in FIG. 3, journals 103R and 103L permit the corresponding shafts 102R and 102L to rotate, but not to translate along the axis of shafts with respect to the journals 103R and 103L.

The shafts 102R and 102L carry driving rollers 104R and 104L respectively that engage one side of flaps 30C and 30A respectively as shown in FIG. 3. The shafts 102R and 102L also are inputs to right-angle drives 105R and 105L. Horizontal cross shafts 106R and 106L interconnect the right-angle drives 105R and 105L through right angle drives 107R and 107L, respectively to rotate horizontal shafts 106R and 106L. Each shaft has a driven roller 109R and 109L positioned on the opposite side of the panels 30C and 30A respectively.

Referring to FIG. 3 particularly, the paper line pathway 28 comprises the different belt assemblies 80, like those shown in FIG. 1, that are spaced across the width of the apparatus. Panels 30B and 30D rest on the belt assemblies 80. A hold down bar 81 and backing bars 82 also hold the panels 30B and 30D against the belts 80 so the blank moves along the pathway with the belt assemblies 80. The backing bars 82 align with the score lines, such as score lines 45 and 46 in FIG. 1, to hold the panels 30B and 30D against the outer belt assemblies 80 during travel through this section 23A.

Figure 4:
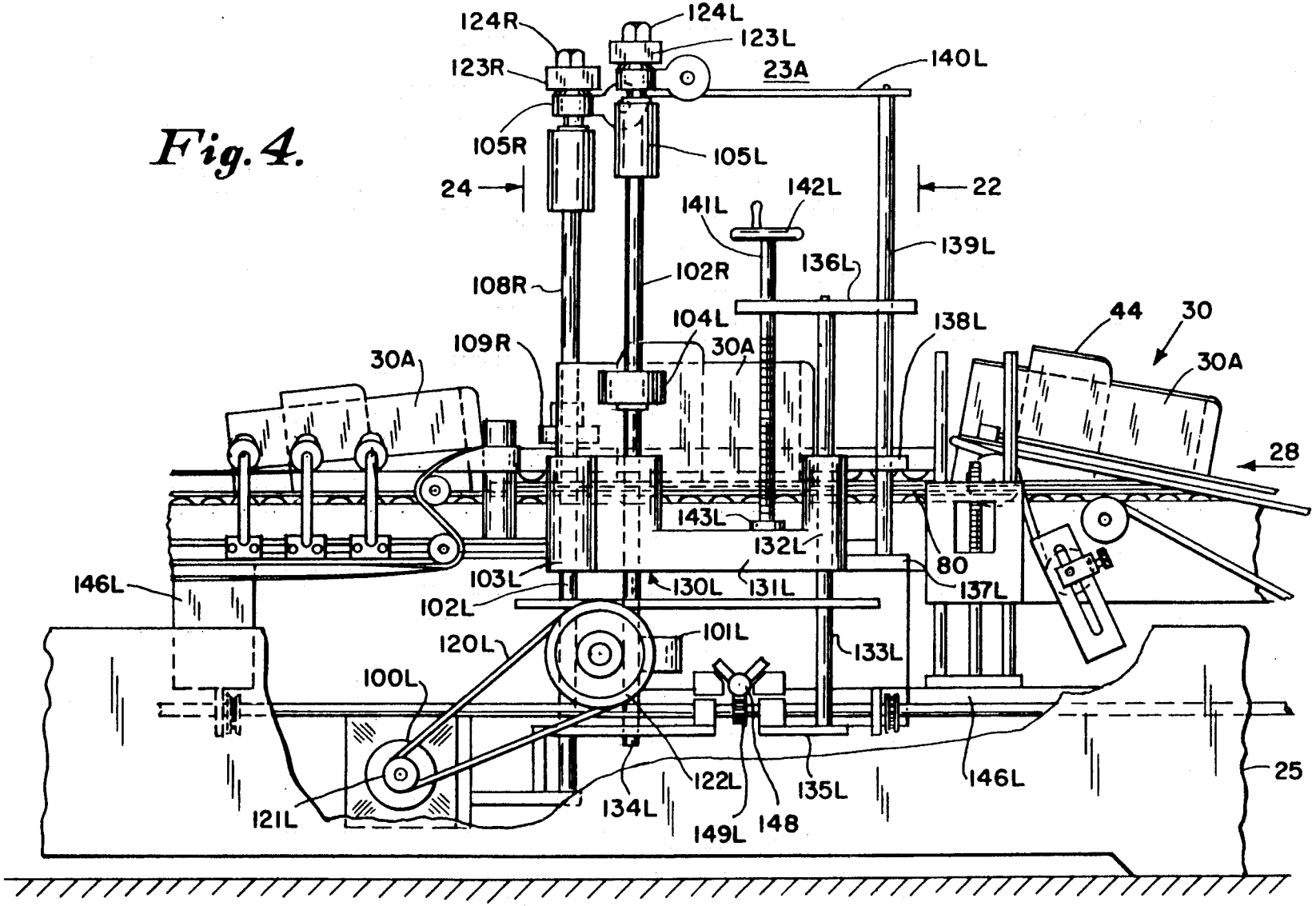
FIG. 4 is a side view taken from the left of FIG. 3.
Figure 5:
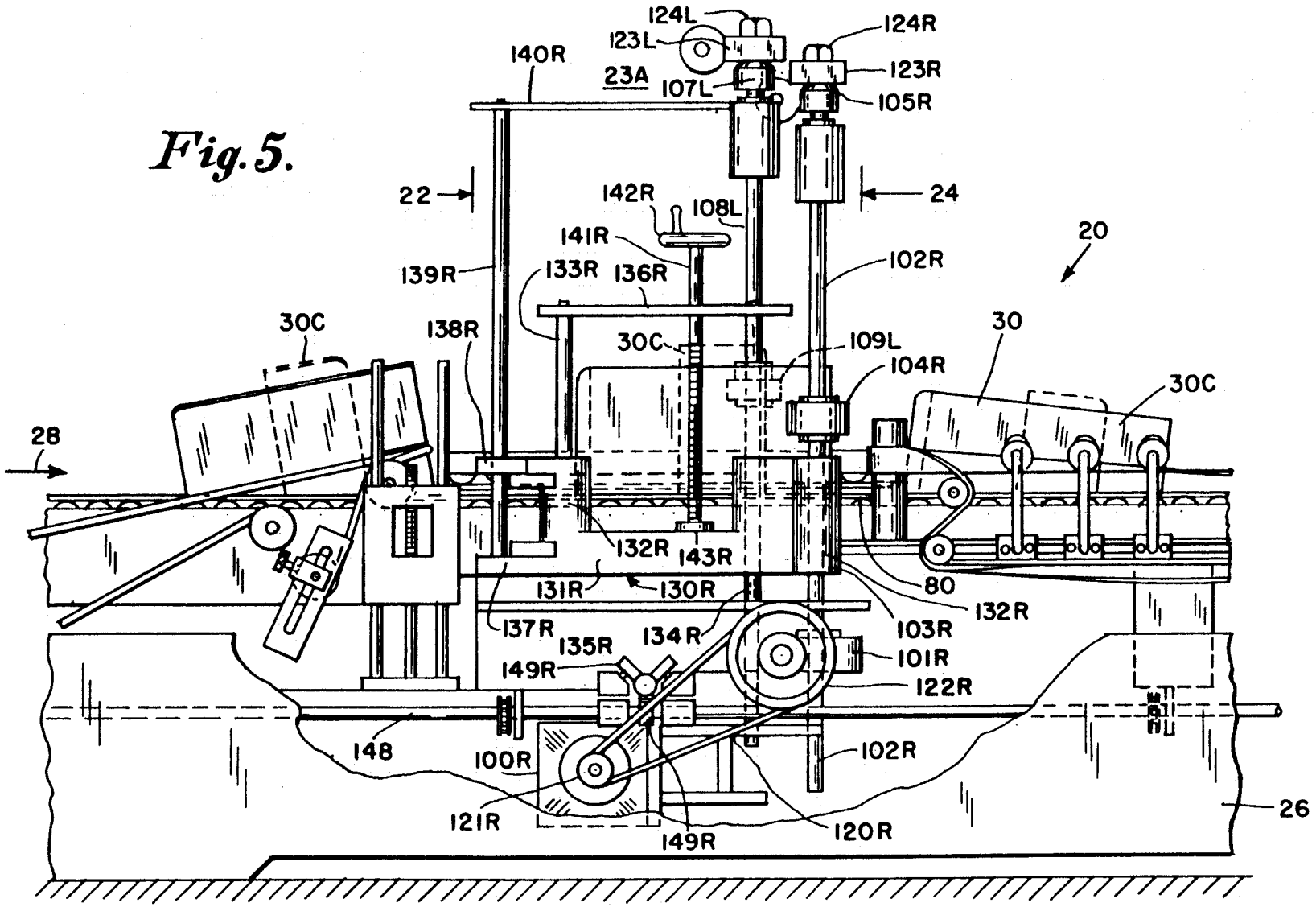
FIG. 5 is a side view taken from the right of FIG. 3.
Figure 6:
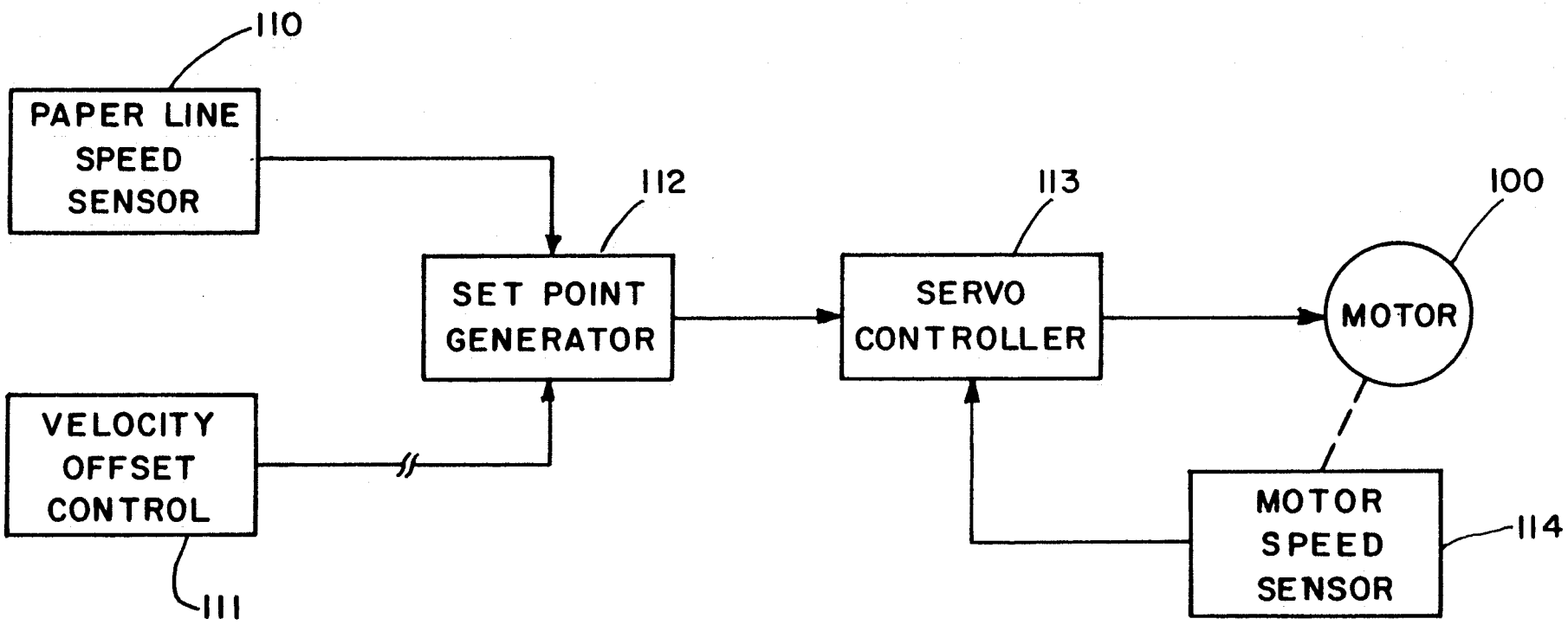
FIG. 6 is a schematic of a control system useful for controlling the apparatus shown in FIGS. 2 through 5.

FIG. 6 discloses, in schematic form, an embodiment of the control system that uses conventional circuits for controlling the operating speed for one motor 100. Apparatus as shown in FIGS. 2 through 5 will comprise two, independently operating control systems for controlling the motors 100R and 100L. Specifically a paper line speed sensor 110 and a velocity offset control 111 feed signals to a set point generator 112. The set point generator 112 provides a summing function output that is a set point for a servo-controller 113. The servo-controller drives one of the motors 110 to the set point speed and a motor speed sensor 114 generates a feed back signal. This arrangement allows the velocity offset control 111 to be located remotely with respect to the rest of the control area. Consequently, an operator can visually monitor the quality of the folds and change the speed of each of the motors 100R and 100L independently. Increasing the motor speed causes the flaps 30A and 30C in FIG. 3 to advance through the station 23A faster than the respective panels 30D and 30B and introduces forward skew. Conversely, reducing motor speed causes the rollers 104 and 109 to slow so the flaps 30A and 30C slow with respect to the panels 30B and 30D and introduce a backward skew. Therefore in accordance with one of the objects of this invention, an operator can control the skew introduced at the station 23A from a remote location with a simple manipulation of the velocity offset control circuit.

Looking at the structure for advancing the flap 30C, the motor 100R drives the right-angle drive 101R by means of a belt 120R and pulleys 121R and 122R mounted on the motor 100R and the right-angle drive 101R respectively. The right-angle drive 101R turns the shaft 102R and its attached driven roller 104R clockwise when viewed from the top. Axial connecting means in the form of the right-angle drives 105R and 107R and the cross connecting shaft 106R cause the shaft 108R, that is parallel to and spaced from the shaft 102R, and its attached driven roller 109R to rotate counterclockwise when viewed from the top of the apparatus. The driven rollers 104R and 109R thereby advance the flap 30C through the station 23A at a speed determined by the motor 100R. A similar, but independent operation occurs with respect to the apparatus for advancing the flap 30A.

The station 23A enables an operator to adjust the spacing between the driving rollers 104R and 109R and independently between the driving rollers 104L and 109L. Referring again to the structure engaging the flap 30C, a cam driven connecting structure 123R interconnects the right-angle drives 105R and 107R. When a cam operator 124R rotates, the cam operated apparatus 123R displaces the right-angle 107R horizontally with respect to the right-angle drive 105R along the axis of the cross shaft 106R. The cross shaft 106R has a spline connection with the right-angle drive 107R to enable this horizontal displacement. An operator merely rotates the cam operator 124R to adjust the spacing between the rollers 104R and 109R for cartons of different thicknesses.

The flap advancing section 23A also allows an operator to control, independently, the position at which the driving rollers 104R and 109R and 104L and 109L engage the flaps 30C and 30A respectively. In FIG. 3, for example, the driving rollers 104L and 109L engage the flap 30A at a point that is higher than the driving rollers 104R and 109R engage the flap 30C. The ability to adjust the contact position allows an operator to adapt a structure not only for cartons with differently sized flaps, but even for a given carton or blank having flaps of different sizes such as shown in FIG. 3 where the flap 30A is deeper than the flap 30C.

Referring particularly to FIGS. 3 and 5, the drive rollers 104R and 109R and the respective mechanisms driven by the right-angle drive 101R mount on an elevator on a flap engagement frame. More specifically, the journal 103R forms one leg of a u-shaped movable elevator frame 130R having a base 131R and another upstanding leg structure 132R. The upstanding leg 132R and the upstanding leg including the journal 103R ride on vertical shafts 133R and 134R respectively. The vertical shafts 133R and 134 attach to a flap engagement frame 135R. Thus the base 130R can slide vertically on the shafts 133R and 134R relative to the flap engagement frame 135R.

The shaft 133R also supports a horizontal frame 136R, and the leg 132R supports two spaced horizontal arms 137R and 138R as extensions of the base 130R. These arms 137R and 138R carry a vertical shaft 139R that slidingly engages the frame 136R. At its upper end the shaft 139R carries another frame 140R that supports the right-angle drives 105R and 107R. Thus, as the base 130R of the elevator moves vertically on the shafts 134R and 135R, it carries the right-angle drives such as the drive 105R and the drive rollers 104R and 109R.

In FIG. 5, an elongated threaded shaft 141R extends through the end of the frame 136R opposite the shaft 139R and carries an operating handle 142R at the end thereof. Thus the shaft 141R is stationary vertically. It also engages a nut 143R formed in the base 130R. Therefore rotation of the operating handle 142R displaces the elevator means including the base 130R and the two rollers 104R and 109R when the handle 142R rotates.

The flap advancing section 23A also accommodates blanks that have differently sized panels 30B and 30D. As shown in FIGS. 3 through 5, the frames 135R and 135L carry the motors 100R and 100L and the remaining structure of the section 23A. These structures are normally centered on the paper line 28 that in turn is centered on a main frame including the frame members 25 and 26. Further, the frame members 135R and 135L connect normally to frame members 146R and 146L of the final fold station 24 that can be positioned on a transverse shaft 148 as well known in the art.

In accordance with another advantage of this invention, when spacing between the folding structures of the folding station 24 changes to accommodate blanks with differently sized panels, the frame members 146R and 146L move along a shaft 147. This motion produces a corresponding change in the spacing of the assemblies of the flap advancing station 23A. The weight provided by the improved structure and the elimination of apparatus in critical positions enables the construction of frame members 135R and 135L to permit this motion to occur without skewing. That is, parallelism is maintained between the left and right sections of both of the improved advancing section 23A and the flap folding section 24A.

Figure 2:
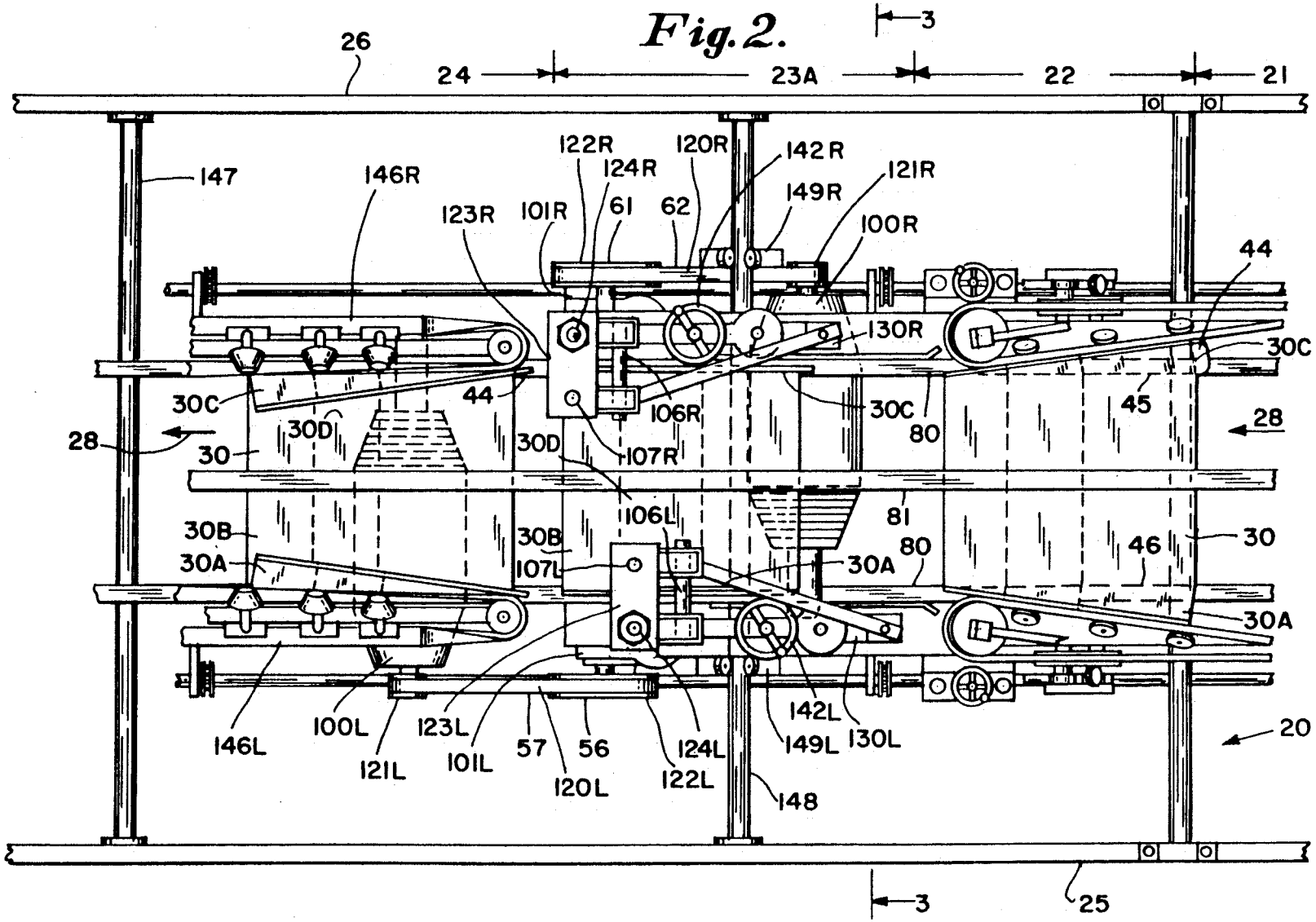
FIG. 2 is a top view of a paper box folding machine shown in FIG. 1 that is modified to incorporate this invention.

More specifically, another supporting shaft 148, as best seen in FIG. 2, connects between the frame members 25 and 26 and parallels the shaft 147. In FIGS. 4 and 5, linear bearing structures 149R and 149L mount to the flap engagement frame members 135R and 135L respectively and ride on the shaft 148. When an operator adjusts the position of the left or right section of the final folding station 24 along the shaft 148, a corresponding displacement occurs along the shaft 150 because this structure, combined with the reduction in weight, allows such motion to occur without skew.

Therefore in accordance with this invention the apparatus of FIGS. 2 through 6 provides apparatus for folding corrugated cardboard box blanks and particularly improves such apparatus by facilitating the adjustment of a position of a flap with respect to a score line on the blank. The use of independently-driven motors and controls enables an operator to control each flap advancing structure independently and remotely. The reduction in the number and weight of mechanical elements increases overall reliability and enables accurate positioning of the flap advancing section 23A simultaneously with other parts of the apparatus, such as the folding station 24.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. In a paper box folding machine for folding a flap onto an attached panel of each of a plurality of box blanks advancing individually and successively at a predetermined velocity along a paper line pathway wherein said machine includes means for folding each flap to a position that is angularly displaced from its attached panel and flap control means for thereafter independently controlling the relative velocity of each flap along the paper line pathway relative to the panel velocity thereby to align each flap with its attached panel, said flap control means comprising:

A. panel advancing means coupled to the paper line pathway for advancing a panel through said flap control means at the predetermined velocity, B. flap engagement means spaced from said panel advancing means including spaced driving means for gripping opposite sides of each flap thereby to move the flap along the paper line, C. electric motor means for driving said flap engagement means, and D. control means for adjusting the speed of said electric motor means and said flap engagement means relative to the velocity of said panel advancing means, said control means including velocity sensor means for generating a panel velocity signal in response to panel velocity, adjustable velocity offset means for generating a velocity offset signal that indicates an incremental velocity change, and means responsive to the panel velocity and offset velocity signals for establishing the operating speed of said electric motor means thereby to enable adjustments of the operation of said flap engagement means relative to the panel.

2. Flap control means as recited in claim 1 for a paper box folding machine adapted for folding blanks with flaps of different thicknesses, said flap control means additionally comprising first spacing control means for adjusting the spacing between said driving means.

3. Flap control means as recited in claim 1 for a paper box folding machine adapted for folding blanks with panels of different size, said flap control means additionally comprising means for adjusting the position of said flap engagement means in the plane of the panel.

4. Flap control means as recited in claim 3 for a paper box folding machine adapted for folding blanks with flaps of different sizes, said flap control means additionally comprising means for adjusting the point at which said driving means in said flap engagement means engage the flap relative to the panel.

5. Flap control means as recited in claim 1 wherein said driving means in said flap engagement means comprises first and second rotatable flap engaging means for engaging the opposite surfaces of the flap and first and second spaced parallel axle means for supporting each of said rotatable flap engaging means for rotation in engagement with the flap.

6. Flap control means as recited in claim 5 for a paper box folding machine having main frame means for supporting said flap control means and being adapted for folding blanks with flaps of different sizes, said flap control means additionally comprising:

i. elevator means for supporting said first and second flap engaging means, ii. flap engagement frame means mounted to the main frame means supporting said elevator means for motion in a plane substantially parallel to the plane of the flap, and iii. adjustment means connected to said elevator means and said flap engagement frame means for controlling the position of said elevator means relative to said flap engagement frame means, said first axle means including means for connection to said motor means for maintaining the driving connection therewith during elevator motion.

7. Flap control means as recited in claim 5 for a paper box folding machine having main frame means for supporting said flap control means and being adapted for folding blanks with panels of different sizes said flap control means additionally comprising flap engagement frame means mounted to the main frame means for supporting said flap engagement means and means for adjusting the position of said flap engagement frame means relative to the main frame means in the plane of the panel.

8. Flap control means as recited in claim 7 for a paper box folding machine further adapted for folding blanks with flaps of different sizes, said flap control means additionally comprising:

i. elevator means for supporting said first and second rotatable flap engaging means, said flap engagement frame means supporting said elevator means for motion in a plane substantially parallel to the plane of the flap, and ii. adjustment means connected to said elevator means and said flap engagement frame means for controlling the position of said elevator means relative to said flap engagement frame means, said first axle means including means for connection to said motor means for maintaining the driving connection therewith during elevator motion.

9. Flap control means as recited in claim 1 wherein said drive means in said flap engagement means include first and second spaced roller means driven by said motor means and carrying said first roller means, and said flap engagement means additionally comprises:

i. first axle means along a first axis substantially parallel to the flap, ii. second axle means along a second axis spaced from and parallel to said first axle means for driving said second roller means mounted thereto, and iii. axle connecting means for connecting said first and second axle means whereby said first axle means drives said second axle means.

10. Flap control means as recited in claim 9 wherein said axle connecting means includes means for adjusting the spacing between said first and second axle means.

11. Flap control means as recited in claim 9 wherein said axle connecting means includes first and second right-angle drive means connected to said first and second axles respectively and cross shaft means interconnecting said first and second right-angle drives whereby said axle connecting means is driven by said first axle means and drives said second axle means.

12. Flap control means as recited in claim 11 wherein said axle connecting means includes displacement means for changing the position of one of said right-angle drives along said cross shaft means thereby to control the spacing between said first and second roller means.

13. Flap control means as recited in claim 9 for a paper box folding machine having main frame means for supporting said flap control means and being adapted for folding blanks with flaps of different sizes, said flap control means additionally comprising:

i. elevator means for supporting said first and second axle means and said axle connecting means, ii. flap engagement frame means mounted to the main frame means for supporting said elevator means for motion in a plane substantially parallel to the plane of the flap, and iii. adjustment means connected to said elevator means and said flap engagement frame means for controlling the position of said elevator means relative to said flap engagement frame means, said first axle means including means for connection to said motor means for maintaining the driving connection therewith during elevator motion.

14. Flap control means as recited in claim 9 for paper box folding machine having main frame means for supporting said flap control means and being adapted for folding blanks with panels of different sizes, said flap control means additionally comprising transverse stationary shaft means connected to the main frame means in a plane parallel to the plane of the panel and flap engagement frame means for supporting said flap engagement means and including bearing means for riding on said transverse stationary shaft means thereby to facilitate motion of said flap control means in the plane of the panel.

15. Flap control means as recited in claim 14 for a paper box folding machine further adapted for folding blanks with flaps of different sizes, said flap control means additionally comprising:

i. elevator means for supporting said first and second axle means and said axle connecting means, said flap engagement frame means supporting said elevator means for motion in a plane substantially parallel to the plane of the flap, and ii. adjustment means connected to said elevator means and said flap engagement frame means for controlling the position of said elevator means relative to said flap engagement frame means, said first axle means including means for connection to said motor means for maintaining the driving connection therewith during elevator motion.

16. A paper box folding machine for folding first and second flaps of a blank onto attached panels as each of a plurality of box blanks advance individually and successively at a predetermined velocity along a paper line pathway, said machine comprising:

A. first and second means for folding independently each of the first and second flaps to positions that are angularly displaced from their respectively attached panels, B. first and second independent flap control means for thereafter independently controlling the relative velocity of each of the first and second flaps along the paper line pathway relative to the panel velocity thereby to align each of said first and second flaps with their respectively attached panels, each of said flap control means including:

1. blank advancing means coupled to the paper line pathway for engaging panels on successive blanks thereby to advance panels through said flap control means at the predetermined velocity, 2. flap engagement means spaced from said blank advancing means including spaced driving means for gripping opposite sides of each flap thereby to move the flap along the paper line, 3. electric motor means for driving said flap engagement means, and 4. control means for adjusting the speed of said electric motor means and said flap engagement means relative to the velocity of said panel advancing means, said control means including velocity sensor means for generating a panel velocity signal in response to panel velocity, adjustable velocity offset means for generating a velocity offset signal that indicates an incremental velocity change, and means responsive to the panel velocity and offset velocity signals for establishing the operating speed of said electric motor means thereby to enable adjustments of the operation of said flap engagement means relative to the panel; and c. first and second final folding means for folding each of the first and second flaps against their respectively adjacent panels.

17. A paper box folding machine as recited in claim 16 adapted for folding blanks with flaps of different thicknesses wherein each of said flap control means additionally comprises first spacing control means for adjusting the spacing between said driving means.

18. A paper box folding machine as recited in claim 16 adapted for folding blanks with panels of different size, each of said flap control means additionally comprising means of adjusting the position of said flap engagement means in the plane of the panel.

19. A paper box folding machine as recited in claim 18 further adapted for folding blanks with flaps of different sizes, each of said flap control means additionally comprising spacing control means for adjusting the point at which said driving means in said flap engagement means engages the flap relative to the panel.

20. A paper box folding machine as recited in claim 16 wherein said driving means in each said flap engagement means comprises first and second rotatable flap engaging means for engaging the opposite surfaces of the flap and first and second spaced parallel axle means for supporting each of said rotatable flap engaging means for rotation in engagement with the flap.

21. A paper box folding machine as recited in claim 20 having main frame means for supporting said flap control means and being adapted for folding blanks with flaps of different sizes, each said flap control means additionally comprising:

i. elevator means for supporting said first and second flap engaging means, ii. flap engagement frame means mounted to said main frame means for supporting said elevator means for motion in a plane substantially parallel to the plane of the flap, and iii. adjustment means connected to said elevator means and said flap engagement frame means for controlling the position of said elevator means relative to said flap engagement frame means, said first axle means including means for connection to said motor means for maintaining the driving connection therewith during elevator motion.

22. A paper box folding machine as recited in claim 20 having main frame means for supporting said flap control means and being adapted for folding blanks with panels of different size, each said flap control means additionally comprising flap engagement frame means mounted to said main frame means for supporting said flap engagement means and means for adjusting the position of said flap engagement frame means in the plane of the panel.

23. A paper box folding machine as recited in claim 22 further adapted for folding blanks with flaps of different sizes, each of said flap control means additionally comprising:

i. elevator means for supporting said first and second rotatable flap engaging means, said flap engagement frame means supporting said elevator means for motion in a plane substantially parallel to the plane of the flap, and ii. adjustment means connected to said elevator and said flap engagement frame means for controlling the position of said elevator means relative to said flap engagement frame means, said first axle means including means for connection to said motor means for maintaining the driving connection therewith during elevator motion.

24. A paper box folding machine as recited in claim 16 wherein said drive means in each said flap engagement means includes first and second roller means and said flap engagement means additionally comprises:

a. first axle means along a first axis substantially parallel to the flap driven by said motor means and carrying said first roller means, b. second axle means along a second axis spaced from and parallel to said first axle means for driving said second roller means mounted thereto, and c. axle connecting means for connecting said first and second axle means whereby said first axle means drives said second axle means.

25. A paper box folding machine as recited in claim 24 wherein each said axle connecting means includes means for adjusting the spacing between said first and second axle means.

26. A paper box folding machine as recited in claim 24 wherein each said axle connecting means includes first and second right-angle drive means connected to said first and second axles respectively and cross shaft means interconnecting said first and second right-angle drives whereby said cross shaft means is driven by said first axle means and drives said second axle means.

27. A paper box folding machine as recited in claim 26 wherein each said axle connecting means includes displacement means for changing the position of one of said right-angle drives along said cross shaft means thereby to control the spacing between said first and second roller means.

28. A paper box folding machine as recited in claim 24 having a main frame means for supporting said flap control means and being adapted for folding blanks with flaps of different sizes, each said flap control means additionally comprising:

i. elevator means for supporting said first and second axle means and said axle connecting means, ii. flap engagement frame means mounted to said main frame means for supporting said elevator means for motion in a plane substantially parallel to the plane of the flap, and iii. adjustment means connected to said elevator means and said flap engagement frame means for controlling the position of said elevator means relative to said flap engagement frame means, said first axle means including means for connection to said motor means for maintaining the driving connection therewith during elevator motion.

29. A paper box folding machine as recited in claim 24 being adapted for folding blanks with panels of different size and having main frame means for supporting transverse stationary shaft means in a plane parallel to the plane of the panel, each said flap control means additionally comprising flap engagement frame means for supporting said flap engagement means, and including bearing means for riding on said transverse shaft means thereby to facilitate motion of each of said flap control means in the plane of the panel.

30. A paper box folding machine as recited in claim 29 further adapted for folding blanks with flaps of different sizes, each said flap control means additionally comprising:

i. elevator means for supporting said first and second axle means and said axle connecting means, said flap engagement frame means supporting said elevator means for motion in a plane substantially parallel to the plane of the flap, and ii. adjustment means connected to said elevator means and said flap engagement frame means for controlling the position of said elevator means relative to said flap engagement frame means, said first axle means including means for connection to said motor means for maintaining the driving connection therewith during elevator motion.

* * * * *